US008209868B2

(12) United States Patent
Schnak et al.

(10) Patent No.: US 8,209,868 B2
(45) Date of Patent: Jul. 3, 2012

(54) DEVICE WITH AN ILLUMINATED BUTTON ASSEMBLY

(75) Inventors: Fred Schnak, Kronberg (DE); Stefan Rehbein, Bad Soden (DE); Gerd Laschinski, Oberursel (DE); Klaus Günther Amsel, Schmitten (DE); Werner Hübscher, Waldenms-Bermbach (DE); Herbert Lessiak, Königstein (DE)

(73) Assignee: The Gillette Company, Boston, MA (US)

( * ) Notice: Subject to any disclaimer, the term of this patent is extended or adjusted under 35 U.S.C. 154(b) by 340 days.

(21) Appl. No.: 12/509,596

(22) Filed: Jul. 27, 2009

(65) Prior Publication Data

US 2011/0016721 A1 Jan. 27, 2011

(51) Int. Cl.

| | |
|---|---|
| ***B26B 19/00*** | (2006.01) |
| ***H01H 19/00*** | (2006.01) |
| ***H01H 9/00*** | (2006.01) |
| ***H01H 3/12*** | (2006.01) |
| ***H01H 13/14*** | (2006.01) |

(52) U.S. Cl. ..... 30/45; 30/526; 200/302.1; 200/302.2; 200/310; 200/313; 200/314; 200/317; 200/341; 15/22.1

(58) Field of Classification Search ..... 30/43.4–45, 30/526–536; 200/302.1, 302.2, 310, 313, 200/314, 317, 332, 332.1, 341, 345; 15/22.1
See application file for complete search history.

(56) References Cited

U.S. PATENT DOCUMENTS

| | | | | |
|---|---|---|---|---|
| 5,258,592 | A | 11/1993 | Nishikawa et al. | |
| 5,343,187 | A * | 8/1994 | Shiao | 200/302.1 |
| 5,362,934 | A | 11/1994 | Inagaki et al. | |
| 5,372,501 | A | 12/1994 | Shalvi | |
| 5,399,821 | A * | 3/1995 | Inagaki et al. | 200/302.2 |
| 5,544,415 | A | 8/1996 | Huang | |
| 5,613,259 | A | 3/1997 | Craft et al. | |
| 6,288,352 | B1 * | 9/2001 | Fukui et al. | 200/1 R |
| 6,369,341 | B2 | 4/2002 | Katsumi | |
| 6,686,549 | B2 * | 2/2004 | Douzono et al. | 200/341 |
| 6,768,070 | B2 | 7/2004 | Lewison et al. | |
| 6,897,389 | B2 | 5/2005 | Li | |
| 6,915,576 | B2 | 7/2005 | Brzezinski | |
| 6,936,783 | B2 | 8/2005 | Kawaguchi et al. | |
| 6,993,803 | B2 | 2/2006 | Chan | |
| 7,041,922 | B2 | 5/2006 | Geiger et al. | |
| 7,126,072 | B2 | 10/2006 | Saitoh | |
| 7,129,432 | B2 * | 10/2006 | Fujii et al. | 200/314 |
| 7,164,092 | B2 * | 1/2007 | Kawano | 200/310 |
| 7,230,195 | B2 * | 6/2007 | Ohnishi | 200/302.1 |
| 7,230,196 | B2 | 6/2007 | Toyama | |
| 7,244,898 | B2 | 7/2007 | Kim | |
| 7,255,466 | B2 | 8/2007 | Schmidt et al. | |

(Continued)

*Primary Examiner* — Jason Daniel Prone
(74) *Attorney, Agent, or Firm* — John M. Lipchitz; Kevin C. Johnson; Steven W. Miller

(57) ABSTRACT

A button assembly for displaying an illuminated symbol has a locking ring and a solid light guide positioned within and spaced apart from the locking ring. The light guide has a top surface for displaying an illuminated symbol and a bottom surface with a light receiving member having a refracting surface with a first lens member for receiving and directing light to the top surface of the light guide. A resilient sealing member interconnects the locking ring and the light guide. The resilient sealing member is mounted on the locking ring and interconnects the locking ring and the light guide. The sealing member has an unsupported portion that facilitates movement of the light guide relative to the locking ring.

9 Claims, 6 Drawing Sheets

U.S. PATENT DOCUMENTS 7,258,229 B2 8/2007 Chan
7,282,657 B2 10/2007 Wimmer et al.
7,367,126 B2 * 5/2008 Freund et al. ..... 30/34.05
7,420,136 B2 9/2008 Goetzl et al.
7,426,338 B2 * 9/2008 Matsumoto et al. ..... 200/339
7,427,724 B2 9/2008 Rochon et al.
7,598,465 B2 * 10/2009 Hirabayashi et al. ..... 200/302.2
7,633,027 B2 * 12/2009 Sakaguchi et al. ..... 200/302.2
7,637,014 B2 * 12/2009 Schnak et al. ..... 30/44
7,685,720 B2 * 3/2010 Efthimiadis et al. ..... 30/527
7,692,111 B1 * 4/2010 Rosing et al. ..... 200/310
7,705,259 B2 * 4/2010 Kenmochi ..... 200/514
7,723,627 B2 * 5/2010 Hotta et al. ..... 200/314
7,810,243 B2 * 10/2010 Schnak et al. ..... 30/526
8,037,608 B2 * 10/2011 Schnak et al. ..... 30/45
8,044,313 B2 * 10/2011 Yamamoto ..... 200/314
2002/0079208 A1 6/2002 Campana et al.
2005/0230233 A1 * 10/2005 Hoehne et al. ..... 200/314
2005/0271997 A1 12/2005 Mikami et al.
2006/0168744 A1 8/2006 Butler et al.
2007/0050981 A1 * 3/2007 Freund et al. ..... 30/41.7
2007/0050982 A1 * 3/2007 Freund et al. ..... 30/41.7
2007/0050983 A1 * 3/2007 Schnak et al. ..... 30/45
2007/0050995 A1 * 3/2007 Schnak et al. ..... 30/526
2007/0050996 A1 * 3/2007 Schnak et al. ..... 30/526
2007/0050997 A1 * 3/2007 Schnak et al. ..... 30/526
2008/0000763 A1 * 1/2008 Cove ..... 200/314
2008/0006549 A1 1/2008 Chan
2008/0028553 A1 2/2008 Batthauer
2008/0110034 A1 * 5/2008 Schnak et al. ..... 30/526
2008/0172880 A1 * 7/2008 Freund et al. ..... 30/45
2009/0119923 A1 * 5/2009 Hart et al. ..... 30/45
2009/0173609 A1 * 7/2009 Liu et al. ..... 200/314
2009/0218204 A1 * 9/2009 Su ..... 200/314
2009/0322230 A1 * 12/2009 Wang et al. ..... 315/136
2010/0038224 A1 * 2/2010 Sato ..... 200/313
2010/0163386 A1 * 7/2010 Sun ..... 200/341
2010/0188329 A1 * 7/2010 Lorenzo Riera et al. ..... 345/156
2010/0314228 A1 * 12/2010 Huang ..... 200/314
2010/0325872 A1 * 12/2010 Schnak et al. ..... 29/593
2011/0036693 A1 * 2/2011 Lin et al. ..... 200/314
2011/0094867 A1 * 4/2011 Dai ..... 200/345
2011/0094869 A1 * 4/2011 Dai ..... 200/534
2011/0147180 A1 * 6/2011 Chen ..... 200/310
2011/0162945 A1 * 7/2011 Chen ..... 200/314
2011/0278145 A1 * 11/2011 Takeda et al. ..... 200/314
2012/0055770 A1 * 3/2012 Chen ..... 200/310

* cited by examiner

DEVICE WITH AN ILLUMINATED BUTTON ASSEMBLY

FIELD OF THE INVENTION

The present invention relates to a button assembly for actuating a switch or other mechanism that requires actuation and more particularly to an illuminated button for small electronic appliances used in wet environments, such as a wet shaving razor or other grooming devices.

BACKGROUND OF THE INVENTION

Powered electronic devices are commonly provided with button assemblies that allow switches, or other mechanisms mounted within the housing of the device, to be actuated from outside of the device. However, when such devices are used in a wet environment, providing a functional button and a fluid seal can be problematic. Providing a seal increases the complexity and cost of the button as well as limits the aesthetics and functionality of the button. The seal can also limit assembly and installation of the button to the housing. For example, elastomeric type push buttons that are used for sealing purposes do not provide the tactile and secure feedback of a rigid push button.

Some buttons have a transparent portion associated with a lighting means, such as an LED to display the respective function. The transparent portion associated with the lighting means does not provide a uniform light over the top surface of the button. These buttons have a combination of dim and bright light impressions on the top surface of the button, resulting in a visually non aesthetic display. Providing a uniform light on the top surface of a button becomes even more problematic if the top surface of the button has both illuminated portions and non-illuminated portions. Illuminated portions and non-illuminated portions may be provided to create an icon or symbol to display the function of the device. A device having an illuminated portion of the button and a seal further increases the complexity and cost of the button, and is thus usually limited to larger household appliances. Typically consumer products, such as shaving razors, have not had much added functionality, because of size and cost limitations.

SUMMARY OF THE INVENTION

In one aspect, the invention features, in general, a button assembly for displaying an illuminated symbol. The button assembly has a locking ring and a solid light guide positioned within and spaced apart from the locking ring. The light guide has a top surface for displaying an illuminated symbol and a bottom surface with a light receiving member having a refracting surface with a first lens member for receiving and directing light to the top surface of the light guide. The button assembly also has a resilient sealing member mounted on the locking ring and interconnecting the locking ring and the light guide. The sealing member has an unsupported portion that facilitates movement of the light guide relative to the locking ring.

In another aspect, the invention features, in general, an electronic grooming appliance having a handle defining an open space therein. The handle has an edge portion defining an opening with a switch positioned within the open space and a light source operatively connected to the switch and positioned within the open space. A button assembly is mounted within the opening of the handle. The button assembly has a locking ring secured to the handle. A solid light guide is positioned within and is spaced apart from the locking ring. The light guide has a top surface for displaying an illuminated symbol, a bottom surface positioned operatively in a facing relationship to the internal switch, and a light receiving member facing the light source. The button assembly has a resilient sealing member that interconnects the locking ring and the light guide. The resilient sealing member compresses the button assembly against the edge portion of the handle to create a liquid impervious seal.

DETAILED DESCRIPTION OF THE INVENTION

Figure 1:
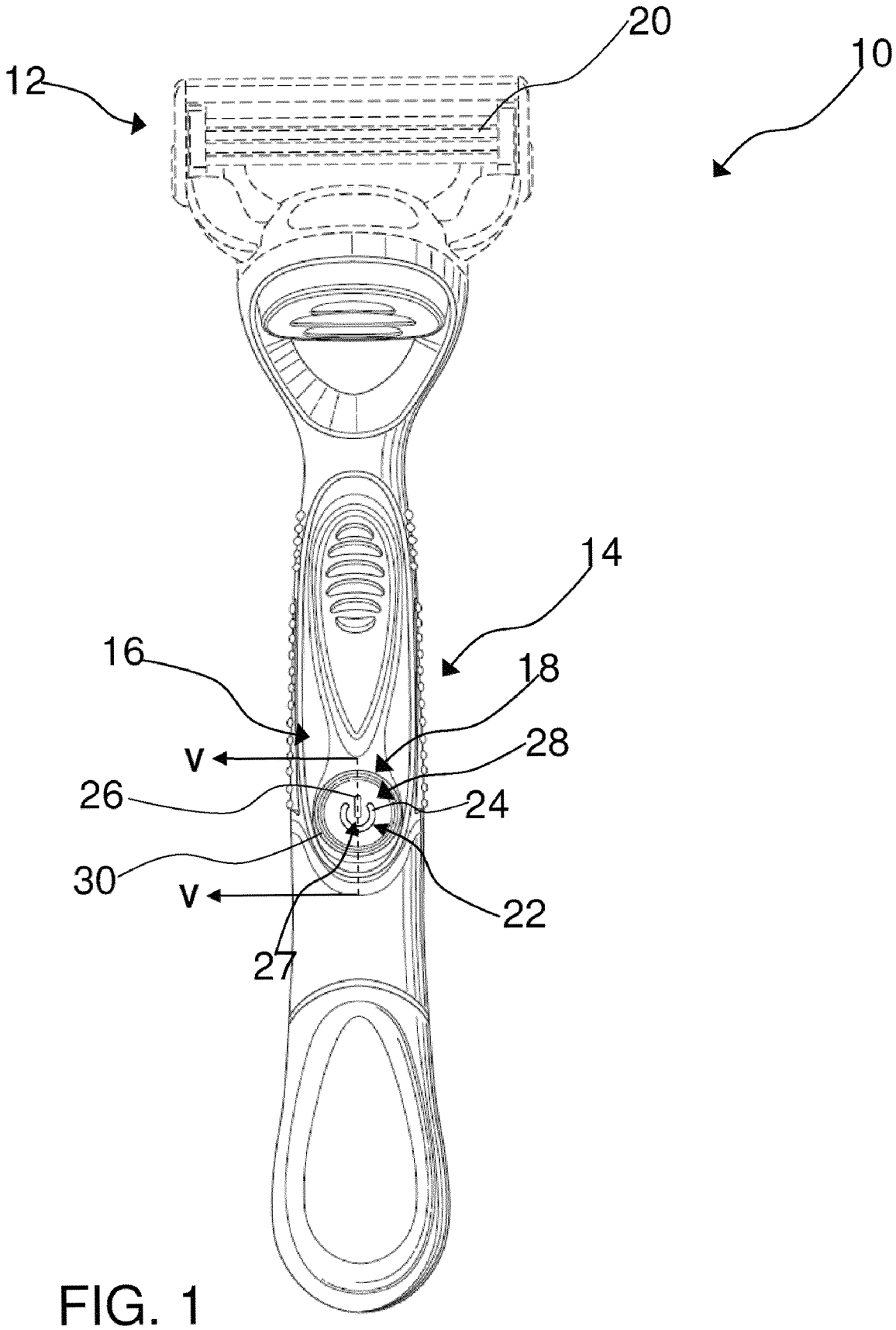
FIG. 1 is a top plan view of one possible embodiment of a shaving system having a button assembly.

Referring to FIG. 1, one possible embodiment of the present invention is shown illustrating a shaving system 10 that includes a cartridge 12 mounted to a handle 14 having a top portion 16 with a button assembly 18. Although a wet shaving system is shown, the button assembly 18 may be utilized on any electronic grooming appliance that may be used in wet environments, such as toothbrushes or dry shaving razors. It may be advantageous for the button assembly 18 to be in close vicinity with an illuminated symbol, which allows consumers to intuitively understand product functionality. For example, an illuminated symbol may be integral with the button assembly 18 for communicating to the user that power to a light source and/or motor is on. The cartridge 12 may carry at least one blade 20 for shaving or trimming hair on the surface of skin. The cartridge 12 may be fixed or pivotably movable relative to the handle 14. In certain embodiments, the cartridge 12 may be mounted detachably to the handle 14 to enable the cartridge 12 to be replaced when sharpness of the blade 20 has diminished to an unsatisfactory level. As will be explained in greater detail below, the button assembly 18 may be used for actuating a switch that controls one or more electrical components. For example, the button assembly 18 may be a push-type button that actuates a switch 62 inside the handle to turn a function on and off. The electrical components may include, but are not limited to light sources, a motors (e.g., to provide vibration to the handle), liquid dispensing pump units, or heating units (e.g., for delivering a heated shaving solution or for delivering heat to the cartridge 12). Although the button assembly 18 is illustrated as being located on the top portion 16 of the handle 14, the button assembly 18 may be located on any surface of the handle 14, such as a bottom surface, a side surface, or at the back of the handle 14.

The button assembly 18 may include a light guide 22 and a resilient seal member 30, which may define a symbol to illustrate a function of the handle 10 (e.g., a motor or light is on or off). The light guide 22 may be manufactured from a transparent or translucent material and may have two or more spaced apart symbol portions 24 and 26 that direct light to a top surface 27 of the light guide 22. The light guide 22 may be solid such that light travels through the material of the light guide 22 in order to exit the light guide 22 and not through a hollow or open space in the light guide 22. The resilient seal member 30 may be opaque and may circumscribe the spaced apart symbol portions 24 and 26 to define an unlit area between the spaced apart symbol portions 24 and 26. The symbol portions 24 and 26 may appear as separate and distinct lighted regions on assembly the top surface 28 of the button assembly 18 to define a symbol or icon, such as a power symbol. Although the spaced apart symbol portions 24 and 26 and the resilient seal member 30 define a power symbol icon, other icons, symbols, letters, numbers, or trademarks may also be used to illustrate a function of the handle 10. The light guide 22 may also display an illuminated symbol that is as simple as a ring or a line, which may include only one symbol portion.

Figure 2:
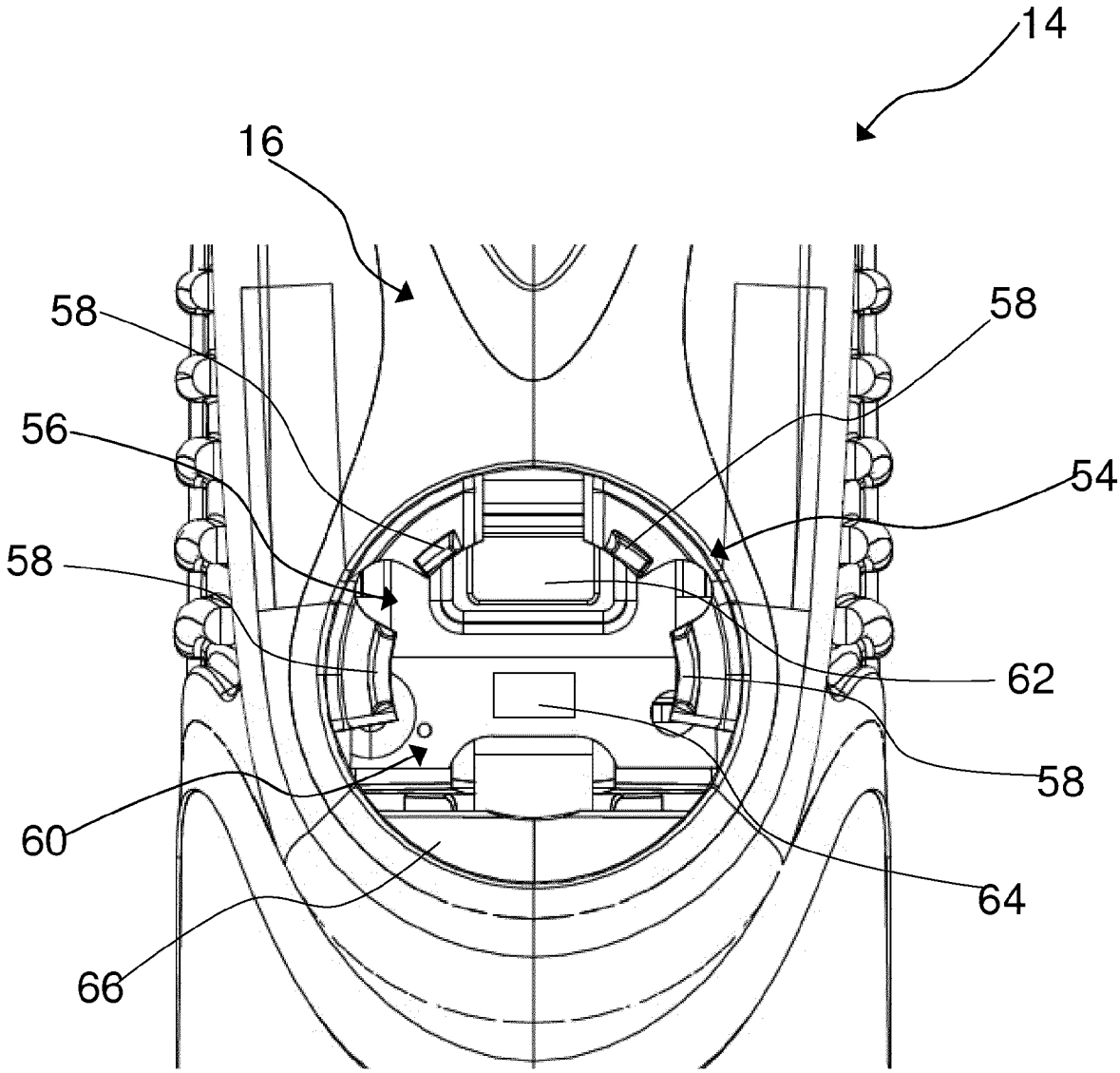
FIG. 2 is an enlarged top plan view of the handle of FIG. 1 with the button assembly removed.

Referring to FIG. 2, a partial top plan view of the handle 14 is shown with the button assembly 18 removed to illustrate various components located within handle 14. The handle 14 may have an edge portion 54 that defines an opening 56 in the top surface 16 of the handle 14 that is dimensioned to receive the button assembly 18. The handle 14 may be hollow to define an open space therein that is in communication with the opening 56. As will be explained in greater detail below, the button assembly 18 may be securely mounted within the opening 56 defined by edge portion 54 of the handle 14 to prevent water ingress. The edge portion 54 may include one or more retaining members 58, (e.g., latch members) to support the button assembly 18 within the opening 56 and facilitate securing the button assembly 18 to the handle 14. The edge portion 54 may include a shoulder 66, which may also support and facilitate the securing of the button assembly 18 to the handle 14. A circuit board 60 may be positioned within the handle 14 to control one or more functions of the shaving razor 10. The circuit board 60 may include an internal switch 62 and one or more light sources 64, such as an LED. The internal switch 62 may be a push-button switch or any other electrically controllable and/or actuated component. The internal switch 62 may be operatively connected (e.g., allows travel of electric current) to power source (e.g., one or more batteries), a light source 64, and/or other electrical components, such as a motor. Although only a light source is shown in FIG. 2, the switch may also be operatively connected to other electronic devices. For example, the internal switch 62 may also be operatively connected to an oscillating motor, so when the internal switch 62 activates the light source 64, the motor is also activated. The light source 64 may emit a white or colored light, such as blue or red. The circuit board 60 may include a plurality of light sources, which may be the same or different colors.

Figure 3:
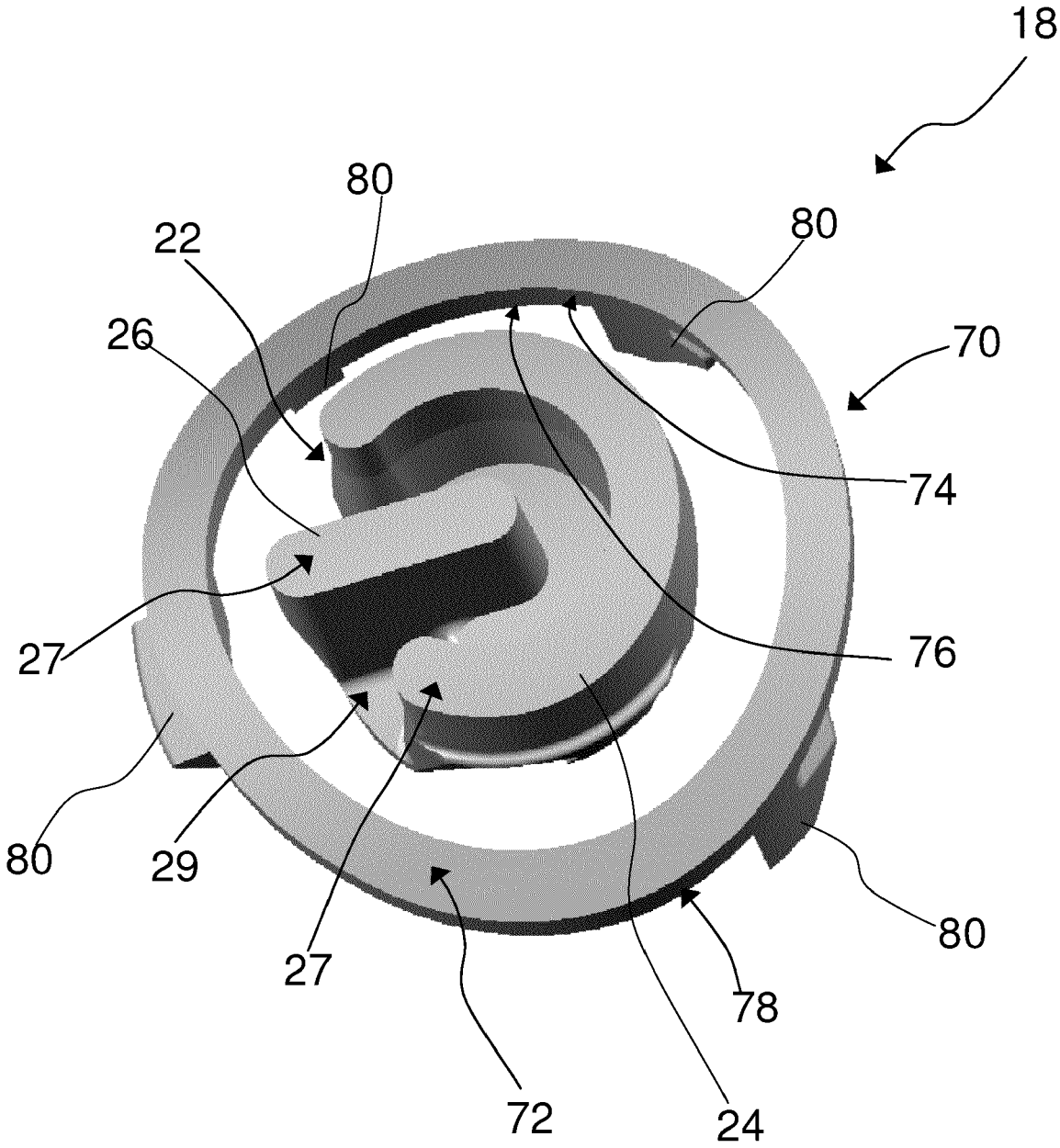
FIG. 3 is a top perspective view of one possible embodiment of a light guide and locking ring which may be incorporated into the button assembly of FIG. 1.

FIG. 3 is a top perspective view of the button assembly 18 with the resilient seal member 30 removed for clarity. The button assembly 18 may include a locking ring 70 that is sized to fit within the opening of the handle 10 (not shown). The locking ring 70 may circumscribe the light guide 22, such that the locking ring 70 is spaced apart from the light guide 22 (i.e., the locking ring 70 does not directly contact the light guide 22). The locking ring 70 may have a top surface 72, an inner surface 74, a bottom surface 76, and an outer surface 78. The bottom surface 76 may have one or more locking members 80 that secure the locking ring 70 (and the button assembly 18) to the handle 14. The locking members 80 may not only provide quick, simple and inexpensive assembly and may also allow provide for quick disassembly if repairs are needed. Alternatively, the button assembly 18 may be secured to the handle 14 by other assembly methods which may be more permanent such as mechanical fasteners, adhesives, ultrasonic welding, or other assembly techniques known by those skilled in the art. The symbol portions 24 and 26 of the light guide 22 may define a recess 29 that separates the top surfaces of symbol portions 24 and 26. In certain embodiments, the recess 29 may be filled in by the resilient seal member 30 (not shown) or another opaque material to block out light projected from the light source 64 (not shown).

Figure 4A:
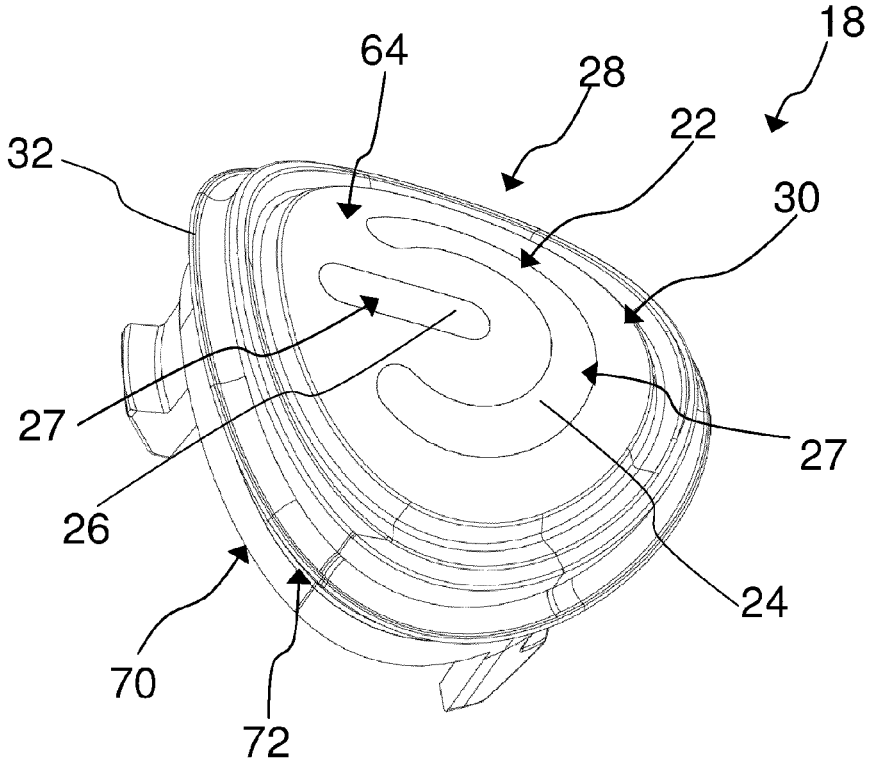
FIG. 4A is a top perspective view of the button assembly of FIG. 1.
Figure 4B:
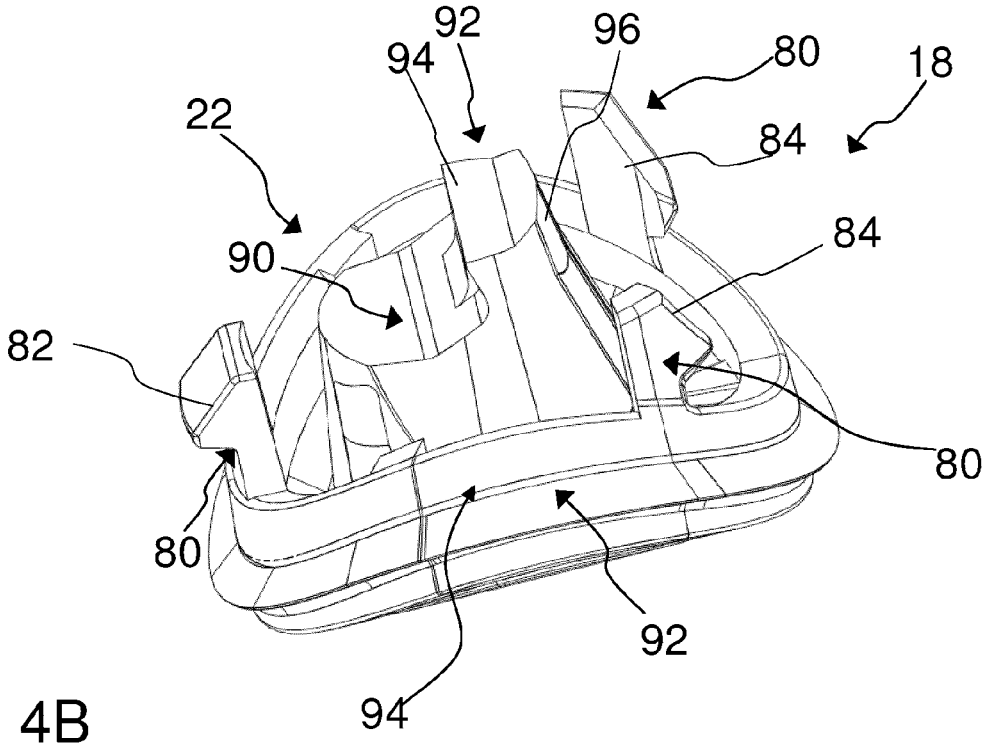
FIG. 4B is a bottom perspective view of the button assembly of FIG. 1.

Referring to FIGS. 4A and 4B, a top perspective view and a bottom perspective view of the button assembly 18 is shown, respectively. FIG. 4A illustrates the resilient seal member 30 joined to the light guide 22 and the locking ring 70 to provide a unitary member. The locking ring 70 and the light guide 22 may be two separate components that are flexibly interconnected by the resilient seal member 30. The sealing member 30 may be positioned within the recess 29 of the light guide 22 and between the light guide 22 and the locking ring 70 to block or limit light transmitted to the top surface 28 of the button assembly 18. The sealing member 30 may be mounted to the top surface 72 of the locking ring 70. The top surface 72 of the locking ring 70 may be positioned below the light guide 22. The resilient seal member 30 may be mounted on the top surface 72 of the locking ring 70 so the top surface 28 is smooth and evenly contoured for enhanced aesthetics and tactile sensation (i.e., the light guide 22 and the resilient seal member 30 are flush). The sealing member 30 may have a flange 32 that extends circumferentially beyond the outer surface 78 of the locking ring 70 to provide a liquid-impervious seal for preventing damage to electrical components located in the handle 14 under normal operating conditions.

The sealing member 30 may facilitate positioning the light guide 22 generally centered within the locking ring 70.

As shown in FIG. 4B, the locking members 80 may have one or more outer latch members 82 that extend outwardly from the locking ring 70 and one or more circumferential latch members 84 that extend along the circumference of the locking ring 70. As will be described in greater detail below, the latch members 82 and 84 may secure the button assembly 18 to the handle 14 by fixing the locking ring to the handle 14. The light guide 22 may have a bottom surface 90 with a light receiving member 92 that projects from the bottom surface 90. The light receiving member 92 may have a refracting surface (e.g., a bottom surface) with lens member 94 that acts as a lens to focus and direct light. The light receiving member 92 may also have another refracting surface (e.g., a side surface) with a lens member 96 to focus and direct light. In certain embodiments, the lens members 94 and 96 may be integral with the light receiving member. For example, the lens members 94 and 96 may include a contoured region of the bottom and side surfaces, respectively. In certain embodiments, the lens member 94 may have one or more concave portions and the lens member 96 may have one or more convex portions to aid in directing and focusing light to the top surface 27 of the light guide 22. The directing and focusing of light to the top surface 27 facilitates a more even distribution of light by minimizing dim and bright light impressions at the top surface 28 of the light guide (from a top view). More or less lens members may be used depending on the positioning of the light source and the availability of a straight or direct path to illuminate the top surface 27 of the light guide 22.

Figure 5A:
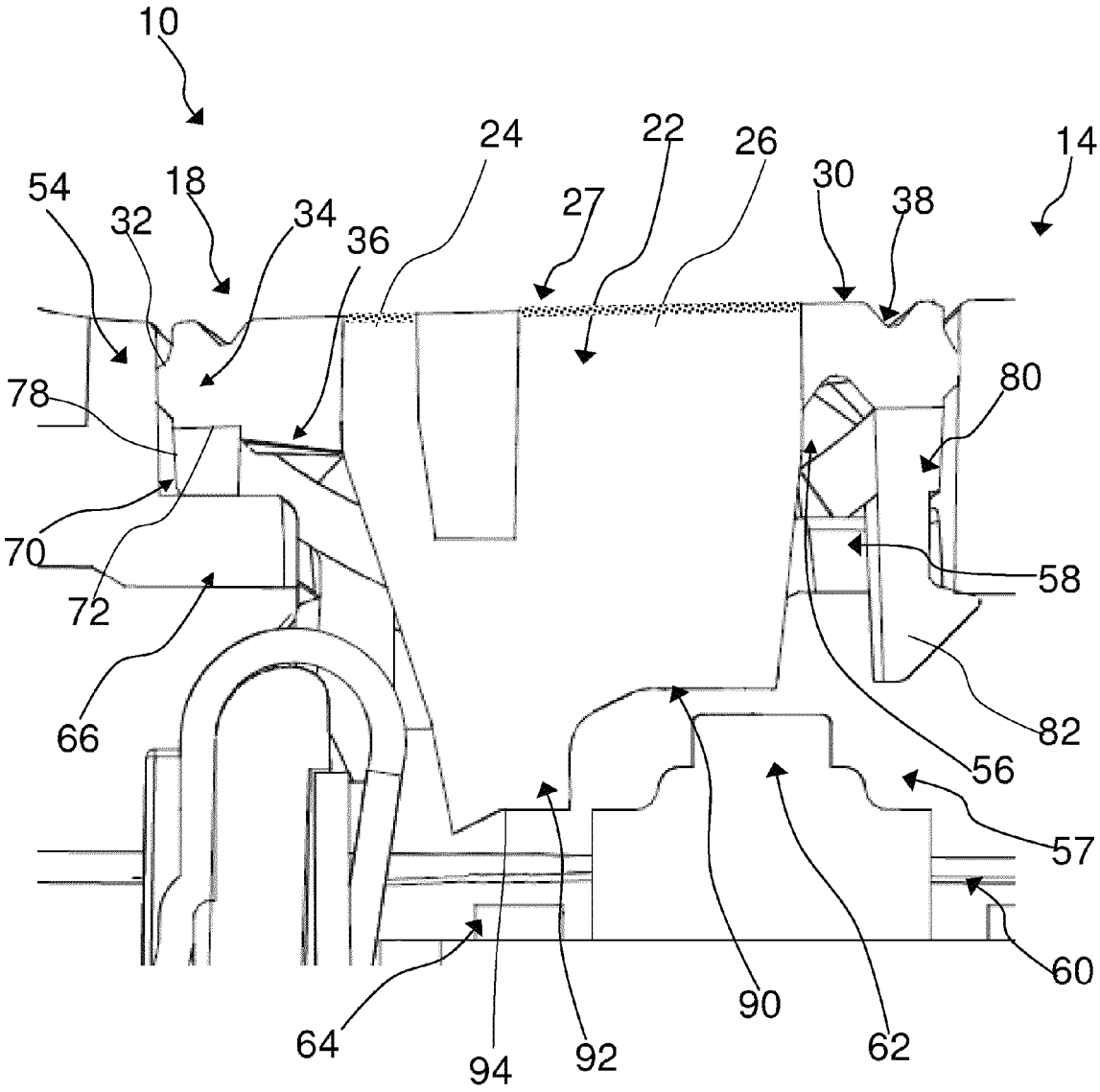
FIG. 5A is a cross sectional view of the shaving system of FIG. 1 in an off position, taken generally along the line V-V.

Referring to FIG. 5A, a cross sectional view of the shaving system 10 is shown in an off position, taken generally along the line V-V of FIG. 1. FIG. 5A illustrates the button assembly 18 secured to the handle 14. The locking ring 70 of the button assembly 18 may be mounted on the shoulder 66 and the retaining members 58 located on the edge portion 54 of the handle 14. The shoulder 66 and the retaining members 58 may prevent the locking ring 70 from moving when the button assembly 18 is pressed down toward the internal switch 62. As the button assembly 18 is inserted into the handle 14 during assembly, the locking member 80 may act as a cantilever beam and deflect against the edge portion 54 until the latch member 82 and latch member 84 (not shown) snap securely into place against a bottom surface of the edge portion 54 or the retaining members 58. Once the locking ring 70 is properly secured in place, the sealing member 30 may provide a liquid impervious seal against the edge portion 54 of the handle 14 under normal operating conditions. The flange 32 may circumferentially compress against the edge portion 54 to prevent water from entering the handle 14 and damaging the circuit board 60, the internal switch 62, the light source 64, or any other internal components of the handle 14.

The light source 64 and the internal switch 62 may be positioned in an open space 57 that is in communication with the opening 56 of the handle 14. The internal switch 62 may be positioned directly adjacent to (e.g., next to, but not necessarily touching) the light source 64 to maximize the limited space within the handle 14. The geometry of the bottom surface 90 and the light receiving member 92 may accommodate the light source 64 by having a lower profile than the internal switch 62. The light receiving member 92 may be positioned directly above the light source 64 to maximize light projected from the light source 64 when the shaving system 10 is turned on. The light receiving member 92 may project from the bottom surface 90 of the light guide such that the light receiving member 92 is adjacent to, but does not contact the internal switch 62. The light guide 22 may function not only to focus and direct light, but may also act as an actuation member to transfer force (either directly or indirectly through a secondary member, such as a lever) to the internal switch 62. In certain embodiments, light guide 22 may have a first position in which the bottom surface 90 of the light guide 22 is positioned operatively in a facing relationship to the internal switch 62 (e.g., capable of contacting the switch 62 either directly or indirectly). Alternatively, the bottom surface 90 may lightly contact the internal switch 62 in the first position, but may not contact the internal switch 62 sufficiently to activate the internal switch 62. In the first position, the internal switch 62 may be in either an open position in which power does not flow from the power source to the light source 64 or a closed position in which power flows from the power source to the light source 64. For example, after the internal switch 62 is activated (to an open or closed position), the light guide 22 may return to its original position (e.g., a first position). The resilient seal member 30 may suspend the light guide 22 above the internal switch 62 to prevent the internal switch 62 from being activated unless the user presses down on the button assembly 18 to turn the shaving system 10 on or off.

A user may press down on the button assembly 18 to power on or off the light source 64, as well as other electronic components of the handle 14, such as a motor. When the button assembly 18 is pressed, the light guide 22 may be moved to a second position to activate the internal switch 62. In the second position, the light receiving member 92 may be positioned temporarily closer to the light source 64 than in the first position; however, the light receiving member 92 may not contact the light source 64. The light source 64 or the light receiving member 92 may become damaged if the light source 64 and the light receiving member 92 contact each other. The resilient seal member 30 may provide sufficient resistance to prevent the light guide 22 from traveling too far, which may prevent the light receiving member 92 from contacting the light source 64. The internal switch 62 may also act as a positive stop against the bottom surface 90 of the light guide 22, which may to prevent the light receiving member 92 from contacting the light source 64.

The resilient seal member 30 may have a supported portion 34 mounted on the top surface of the locking ring 70 and an unsupported portion 36 between the supported portion 34 and the light guide 22. The unsupported portion 36 may facilitate flexing of the resilient seal member 30 and may permit the light guide 22 to move in a downward direction toward the internal switch 62. The unsupported portion 36 may have a thickness of about 0.3 mm, 1.0 mm, or 5 mm to about 0.3 mm, 1.0 mm, or 5 mm. The resilient seal member 30 may also have a groove 38 extending around a circumference of the resilient seal member 30 to enhance the flexibility of the resilient seal member 30 and further facilitate and control movement of the light guide 22 toward the internal switch 62. The groove 38 may have a depth of about 0.1 mm, 0.2 mm, or 0.3 mm to about 0.5 mm, 1 m, or 2 mm. The groove 38 may have a width of about 0.2 mm, 0.5 mm, or 0.7 mm to about 1 mm, 2 mm, or 4 mm. The light guide 22 may travel axially relative to the handle 14 and the locking ring 70 to activate the internal switch 62. The locking ring 70 may remain secured to the handle 14 when the button assembly 18 is pressed. The elastic properties of the resilient seal member 30 may facilitate the light guide 22 to return to its original position (i.e., the first position) after the internal switch 62 is activated. The internal switch 62 may also be spring loaded to aid in returning the light guide 22 to the first position. The internal switch 62 and/or the light guide 22 may provide an audible or tactile feedback to the user signaling the internal switch 62 has been activated (e.g., a click sound).

Figure 5B:
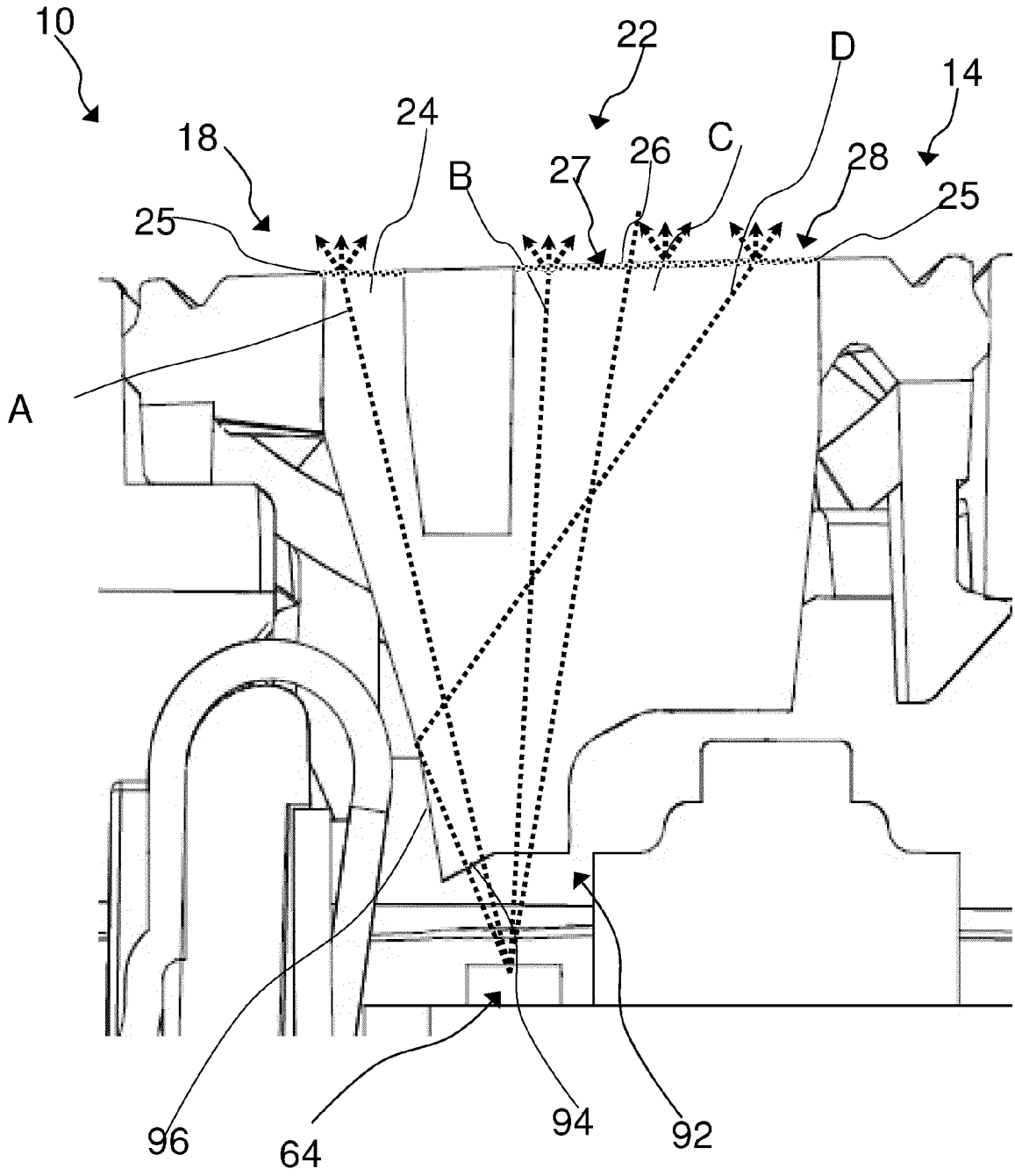
FIG. 5B is a cross sectional view of the shaving system of FIG. 1 in an on position, taken generally along the line V-V.

Referring to FIG. 5B, a cross sectional view of the shaving system 10 is shown in the on position, taken generally along the line V-V of FIG. 1. A plurality of light beams A, B, C, and D may be emitted from the light source 64. The light source 64 may be positioned as close as possible to a center of the light guide 22 to maximize the amount of light that is projected directly to the top surface 27 of the light guide 22 (e.g., light beam C). Light that has a direct exit path results in a bright light impression from a top view of the button assembly 18. Some light beams may not have a direct path to exit the light guide 22 at the top surface 27 of the light guide 22, which typically produces indirect illumination by total reflection resulting in a flat angle of the exit light and a dim light impression from a top view of the power button 18. The lens member 96 may focus and direct light (e.g., light beam D) toward the top surface 27. The lens member 94 at the bottom surface of the light guide 22 may also focus and direct light (e.g., light beam A and B) toward the top surface 27. The directing and focusing of light to the top surface 27 of the light guide 22 facilitates a more even distribution of light by minimizing dim and bright light impressions. More or less lens structures may be used depending on the positioning of the light source 64 and the availability of straight or direct paths to illuminate the top surface 27. The top surface 27 of the light guide 22 may have a scattering structure 25 to facilitate the distribution of light from the light source 64 in different directions along the top surface 27. The scattering structure 25 may be a textured or roughened surface or may be a separate component molded or joined to the top surface 27 of the light guide 22. For example, the scattering structure 25 may be an impregnated substrate that distributes light from the light source 64 along the top surface 27. The scattering of light in different directions may improve the uniform appearance of light exiting the light guide 22 by minimizing dim and bright light impressions.

The locking ring 70 and the light guide 22 may be two separate components that are flexibly interconnected by the resilient seal member 30. In certain embodiments, the resilient seal member 30 may be co-injection molded or insert molded to interconnect the light guide 22 and the locking ring 70. The locking ring 70 and/or the light guide 22 may comprise translucent regions, transparent regions, and combinations thereof. For example, the locking ring 70 and/or the light guide 22 may be molded from polymers that are capable of transmitting light (e.g., ASTM D 1003 haze value (39.4 mil) of less than 15%) which are also rigid, such as polypropylene or polycarbonate. The locking ring 70 does not necessarily need to be transparent or translucent. A rigid polymer having a Shore A hardness of about 50, 60, or 70 to about 90, 110, or 120 may allow for simple and reliable mechanical assembly of the locking ring 70 to the handle 14 and may facilitate the transfer and tactile feedback of force from the light guide 22 to the internal switch 62. The resilient seal member 30 may be molded from a flexible polymer that permits the light guide 22 to move relative to the locking ring 70 and the handle 14 when a user presses the button assembly 18. Polymers having a Shore A hardness of about 20, 30, or 40 to about 50, 60, or 70 and an elongation at break (DIN 533504/ISO 37) of about 300%, 400%, or 500% to about 600%, 700%, or 900% may provide sufficient flexibility. The resilient seal member 30 may also be molded from a polymer material that chemically bonds to the material of the light guide 22, thus preventing separation of the light guide 22 from the locking ring 70 during use. Suitable materials for the resilient seal member 30 may include thermoplastic elastomers (TPEs), such as Thermolast K TF5STE from KRAIBURG TPE Corporation. Suitable materials for the light guide 22 that provide sufficient transparency and bonding to the resilient seal member 30 may include Metocene HM648T polypropylene from Lyondell Basell Industries.

The button assembly 18 integrates several different functions in a small single button having a simple design with low manufacturing cost. As previously described, the button assembly 18 may provide for simple and reliable mechanical assembly and liquid-tight sealing of the handle 14 to prevent water ingress. The button assembly 18 may also provide even light transmission for an illuminated symbol and transfer force from a user to the internal switch 62.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". In an effort to avoid any ambiguity, for the purposes of this disclosure, the term "portion" shall be construed as meaning less than 50%. For example, the term "distal end portion" should be interpreted as from about 0%, 5%, 10%, or 15% to about 15%, 20%, 25%, 30%, 40% or 45% from the terminal end of the element referenced. Similarly, the term "proximal end portion" should be interpreted as from about 0%, 5%, 10%, or 15% to about 15%, 20%, 25%, 30%, 40% or 45% from the end opposite the terminal end of the element referenced.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electronic grooming device comprising:

a handle defining an open space therein, the handle having an edge portion defining an opening;

an internal switch positioned within the open space;

a light source positioned within the open space and operatively connected to the internal switch;

a power button assembly mounted within the opening of the handle, the power button assembly including a locking ring secured to the handle;

a transparent light guide positioned within the locking ring and spaced apart from the locking ring, the light guide having a top surface for displaying an illuminated symbol and a projection extending downward from a central portion of the top surface including a bottom surface positioned operatively in a facing relationship to the internal switch and a light receiving member facing the light source; and a resilient sealing member interconnecting the locking ring and the light guide, wherein the resilient sealing member compresses against the edge portion of the handle to create a liquid impervious seal.

2. The electronic grooming device of claim 1 wherein when the power button assembly is actuated, the resilient sealing member flexes to permit the bottom surface of the light guide to contact the internal switch to illuminate the light source.

3. The electronic grooming device of claim 2 wherein the resilient sealing member flexes to permit the bottom surface of the light guide to directly contact the internal switch to illuminate the light source.

4. The electronic grooming device of claim 2 wherein the locking ring has one or more locking members securing the locking ring to the handle.

5. The electronic grooming device of claim 1 wherein the light receiving member is positioned directly above the light source.

6. The electronic grooming device of claim 1 wherein the sealing member is opaque and circumscribes the light guide.

7. The electronic grooming device of claim 6 wherein the illuminated symbol includes a plurality of spaced apart symbol portions that define a recess that separates respective top surfaces of the symbol portions of the light guide.

8. The electronic grooming device of claim 6 wherein the light receiving member has a refracting surface with a first lens member to direct light projected from the light source toward the top surface of the light guide.

9. The electronic grooming device of claim 8 wherein the first lens member has one or more convex portions.

* * * * *